US010809658B2

(12) United States Patent
Hirota

(10) Patent No.: US 10,809,658 B2
(45) Date of Patent: Oct. 20, 2020

(54) CLEANING BLADE, MANUFACTURING METHOD OF THE CLEANING BLADE, PROCESS CARTRIDGE AND IMAGE FORMING APPARATUS

(71) Applicant: CANON KABUSHIKI KAISHA, Tokyo (JP)

(72) Inventor: Shingo Hirota, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/505,952

(22) Filed: Jul. 9, 2019

(65) Prior Publication Data

US 2020/0026234 A1 Jan. 23, 2020

(30) Foreign Application Priority Data

Jul. 18, 2018 (JP) ..... 2018-135335

(51) Int. Cl.
*G03G 21/00* (2006.01)

(52) U.S. Cl.
CPC ..... *G03G 21/0017* (2013.01)

(58) Field of Classification Search
CPC ..... G03G 21/0017; G03G 21/0011
See application file for complete search history.

(56) References Cited

U.S. PATENT DOCUMENTS

| | | | | |
|---|---|---|---|---|
| 6,044,245 | A * | 3/2000 | Kabashima | G03G 21/0017 399/350 |
| 7,630,678 | B2 | 12/2009 | Kishi et al. | |
| 7,773,934 | B2 | 8/2010 | Kishi et al. | |
| 9,411,300 | B2 | 8/2016 | Al | |
| 2009/0041519 | A1* | 2/2009 | Uchida | G03G 21/0017 399/350 |
| 2016/0327899 | A1* | 11/2016 | Abe | G03G 21/0017 |
| 2018/0043398 | A1* | 2/2018 | Osajima | G03G 21/0017 |
| 2019/0196389 | A1 | 6/2019 | Hirota | |

FOREIGN PATENT DOCUMENTS

| | | | |
|---|---|---|---|
| JP | 2009-42581 | A | 2/2009 |
| JP | 2015-222302 | A | 12/2015 |
| JP | 2018-54956 | A | 4/2018 |

* cited by examiner

*Primary Examiner* — Sandra Brase
(74) *Attorney, Agent, or Firm* — Venable LLP

(57) ABSTRACT

A cleaning blade includes an elastic material, a first surface, a second surface and an end surface. The end surface includes a first region and a second region provided on opposite sides of the first region. The elastic material of the cleaning blade has indentation elastic modulus $E_0$ [MPa] of 3 or more and 20 or less, and indentation elastic modulus $E_1$ [MPa] of the end surface in the first region is ($E_0$+1) or more and 40 or less. Dynamic hardness DH1 [mN/μm$^2$] of the first region is 0.10 or more and 0.20 or less, dynamic hardness DH2 [mN/μm$^2$] of the second region is 0.15 or more and 0.50 or less, and a difference (DH2−DH1) is 0.05 [mN/μm$^2$] or more. A difference in thickness between the end surface in the first region and the end surface in the second region is 25 μm or less.

16 Claims, 4 Drawing Sheets

(a)

(b)

CLEANING BLADE, MANUFACTURING METHOD OF THE CLEANING BLADE, PROCESS CARTRIDGE AND IMAGE FORMING APPARATUS

FIELD OF THE INVENTION AND RELATED ART

The present invention relates to a cleaning blade for cleaning a surface of an image bearing member, a manufacturing method of the cleaning blade, a process cartridge including the cleaning blade, and an image forming apparatus including the cleaning blade.

In an image forming apparatus of an electrophotographic type, a cleaning blade for cleaning a surface of an image bearing member such as a photosensitive drum or an intermediary transfer belt by scraping off a deposited matter such as transfer residual toner remaining on the image bearing member without being transferred onto a recording material while being contacted to the image bearing member has been used. As the cleaning blade, a blade made of a rubber material such as a urethane rubber has been widely used, but such a blade is in a state that a free end portion of the blade is curled up by being drown by a rotating image bearing member and thus cleaning power cannot be exhibited in some cases. Particularly, on an outside of an image forming region in which a toner image is formable on the image bearing member, toner and an external additive which perform the function of a lubricant are not readily supplied between the cleaning blade and the image bearing member, and therefore, curling-up of the cleaning blade occurs from a blade end portion as a starting point.

Japanese Laid-Open Patent Application (JP-A) 2009-42581 discloses a constitution in which of an end surface of a cleaning blade, prepared by molding an urethane rubber, opposing a photosensitive drum, only a region of each of opposite end portions of the cleaning blade with respect to a longitudinal direction of the photosensitive drum is subjected to surface treatment for curing an isocyanate compound impregnated in the cleaning blade only in the region. According to this constitution, the end surface region of the cleaning blade positioned outside the image forming region is cured, and therefore, curling-up of a free end portion of the blade is suppressed.

However, in the case where a treating liquid for curing is impregnated in the cleaning blade at the end surface, a portion where the treating liquid is impregnated in the cleaning blade swells, and therefore, a dimension of the end surface of the cleaning blade with respect to a thickness direction of the cleaning blade changes depending on whether or not the surface treatment is performed. Accordingly, at an edge portion of the cleaning blade, prepared by a method disclosed in JP-A 2009-42581, contacting the photosensitive drum, a stepped portion (step height) is formed between a treated portion where the surface treatment is performed and a non-treated portion where the surface treatment has not been performed. This stepped portion becomes larger with an increasing impregnation amount of the treating liquid, and therefore, the stepped portion increases with an increasing degree of prevention of curling-up with high reliability by setting hardness of the treated portion at a value higher than hardness of the non-treated portion, so that a slip of the toner through between the cleaning blade and the photosensitive drum is liable to occur at the stepped portion.

SUMMARY OF THE INVENTION

A principal object of the present invention is to provide a cleaning blade capable of not only suppressing curling-up of the cleaning blade but also reducing a degree of a slip of toner through between the cleaning blade and a photosensitive drum (image bearing member), and a manufacturing method of the cleaning blade. Another object of the present invention is to provide a process cartridge and an image forming apparatus, which include the cleaning blade.

According to an aspect of the present invention, there is provided a cleaning blade for cleaning a surface of an image bearing member, the cleaning blade comprising: an elastic material as a base material; a first surface; a second surface opposite from the first surface with respect to a thickness direction of the cleaning blade; and an end surface extending in the thickness direction and connecting the first surface and the second surface, wherein the cleaning blade is contactable to the image bearing member at an edge line portion between the first surface and the end surface, wherein the end surface includes a first region including a central position thereof with respect to a longitudinal direction of the image bearing member and includes a second region provided on each of one side and the other side of the first region with respect to the longitudinal direction, and the elastic material has indentation elastic modulus $E_0$ [MPa] of 3 or more and 20 or less at a depth of 1000 μm from the end surface and at an intermediary position between the first surface and the second surface, wherein indentation elastic modulus $E_1$ [MPa] of the end surface in the first region is ($E_0$+1) or more and 40 or less, dynamic hardness DH1 [mN/μm$^2$] of the first region is 0.10 or more and 0.20 or less, dynamic hardness DH2 [mN/μm$^2$] of the second region is 0.15 or more and 0.50 or less, and a difference (DH2−DH1) in dynamic hardness between the first region and the second region is 0.05 [mN/μm$^2$] or more, and wherein a difference in dimension in the thickness direction between the end surface in the first region and the end surface in the second region is 25 μm or less.

According to another aspect of the present invention, there is provided a manufacturing method of a cleaning blade for cleaning a surface of an image bearing member, the manufacturing method comprising: a molding step of molding an elastic material as a base material into a plate-like molded blade member including a first surface, a second surface opposite from the first surface with respect to a thickness direction of the cleaning blade, and an end surface extending in the thickness direction and connecting the first surface and the second surface, wherein the elastic material has indentation elastic modulus $E_0$ [MPa] of 3 or more and 20 or less; a first treatment step of curing a curable material in a first region and a second region of the end surface of the molded blade member so that indentation elastic modulus $E_1$ [MPa] of the end surface is ($E_0$+1) or more and 40 or less and so that dynamic hardness DH1 [mN/μm$^2$] of the end surface is 0.10 or more and 0.20 or less, wherein the first region is a region including a central position of the end surface with respect to a longitudinal direction of the image bearing member, the second region is a region provided on each of one side and the other side of the first region with respect to the longitudinal direction; a second treatment step of curing an isocyanate compound in the second region of the molded blade member through impregnation of the isocyanate compound in the molded blade member in the second region so that dynamic hardness DH2 [mN/μm$^2$] of the second region is 0.15 or more and 0.50 or less and so that a difference (DH2−DH1) in dynamic hardness between the first region and the second region is 0.05 [mN/μm$^2$] or more.

According to another aspect of the present invention, there is provided a process cartridge comprising: an image bearing member; a charging device configured to electrically charge a surface of the image bearing member; a developing device including a developer carrying member, for carrying a developer containing toner and configured to develop, into a toner image, a latent image formed on the image bearing member by an exposure device; and the above-described cleaning blade configured to clean the surface of the image bearing member, wherein with respect to a longitudinal direction of the image bearing member, an end portion on an outside of a developer carrying region where the developer carrying member is capable of carrying the developer is positioned outside an image forming region where the exposure device is capable of forming the latent image on the image bearing member, and a boundary position of the cleaning blade between the first region and the second region with respect to the longitudinal direction is outside of the image forming region and inside of the developer carrying region with respect to the longitudinal direction.

According to a further aspect of the present invention, there is provided an image forming apparatus comprising: an image bearing member; an exposure device configured to expose the image bearing member to light to write a latent image on a surface of the image bearing member; a developing device including a developer carrying member, for carrying a developer containing toner and configured to develop, into a toner image, a latent image borne on the image bearing member; a transfer device configured to transfer the toner image from the image bearing member onto a recording material; and the above-described cleaning blade configured to clean the surface of the image bearing member, wherein with respect to a longitudinal direction of the image bearing member, an end portion on an outside of a developer carrying region where the developer carrying member is capable of carrying the developer is positioned outside an image forming region where the exposure device is capable of forming the latent image on the image bearing member, and a boundary position of the cleaning blade between the first region and the second region with respect to the longitudinal direction is outside of the image forming region and inside of the developer carrying region with respect to the longitudinal direction.

Further features of the present invention will become apparent from the following description of exemplary embodiments with reference to the attached drawings.

Figure 3:
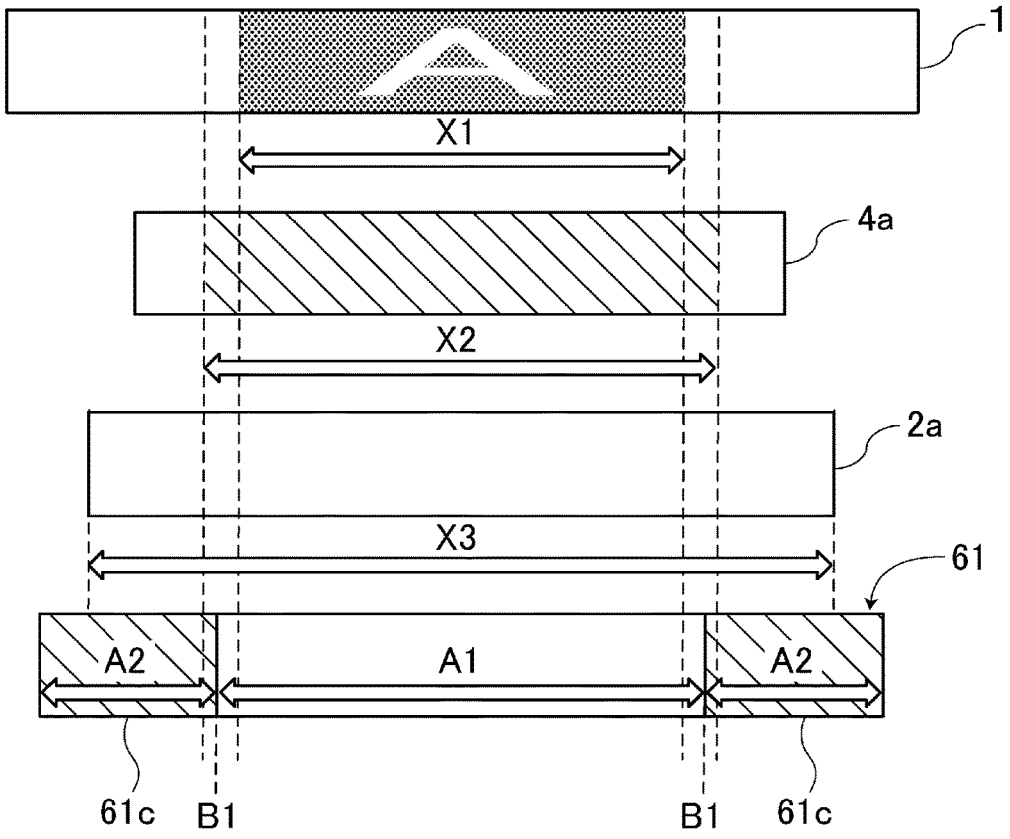
Figure 3:
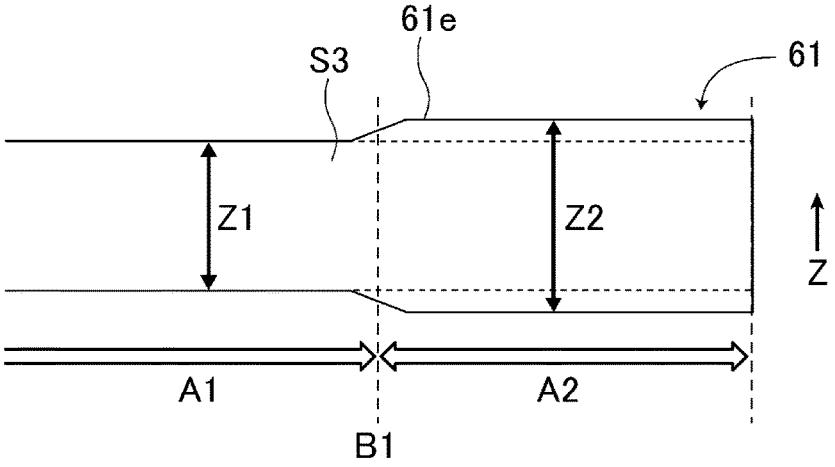

Part (a) of FIG. 3 is a schematic view showing a relationship between a length of the cleaning blade according to the present invention and a length of each of lengths of respective portions of the image forming apparatus, and part (b) of FIG. 3 is a schematic view showing an end surface of the cleaning blade.

Figure 4:
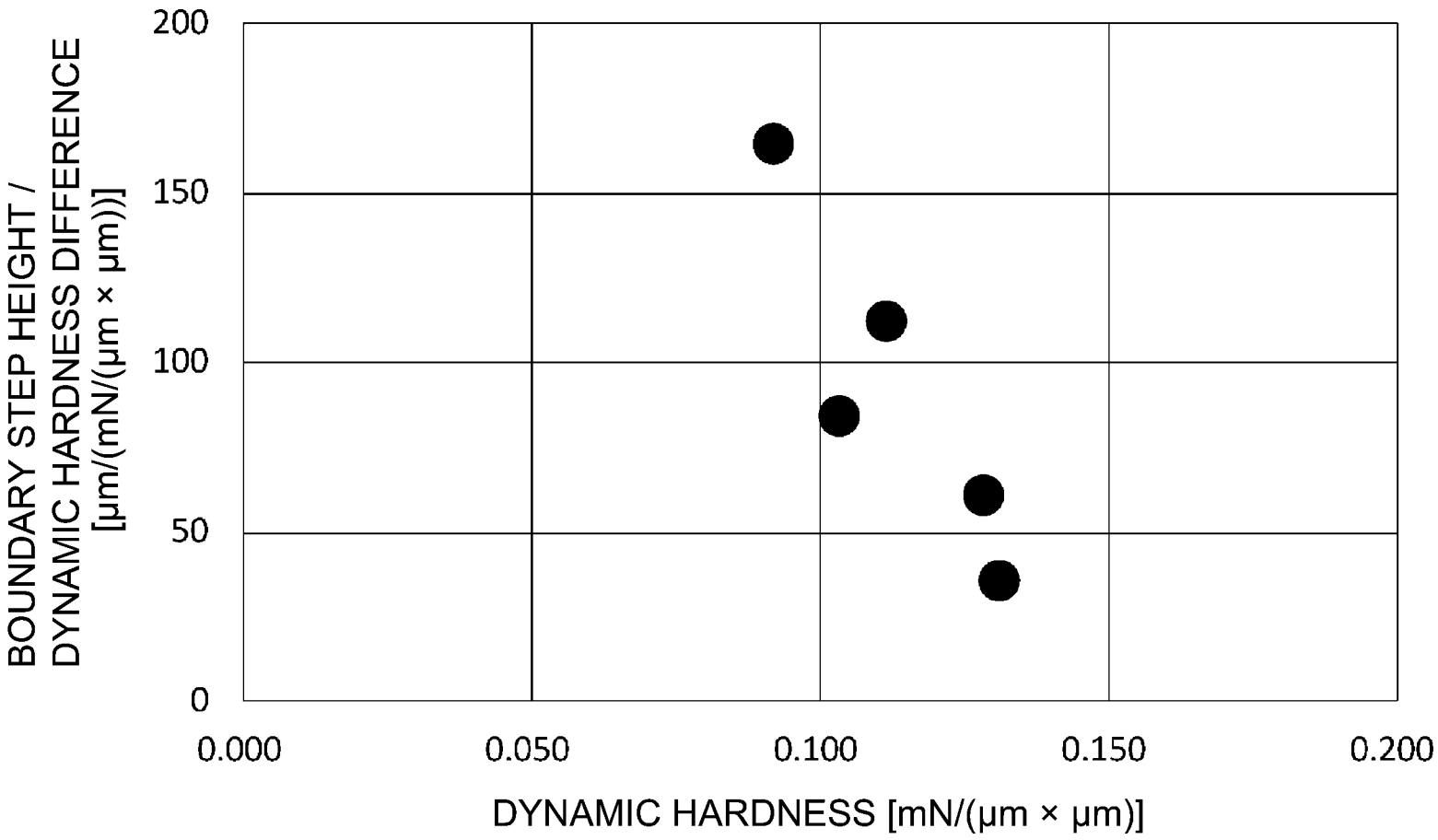

FIG. 4 is a graph showing a relationship between dynamic hardness of the cleaning blade according to the present invention and an index indicating ease of swelling.

DESCRIPTION OF EMBODIMENTS

Figure 1:
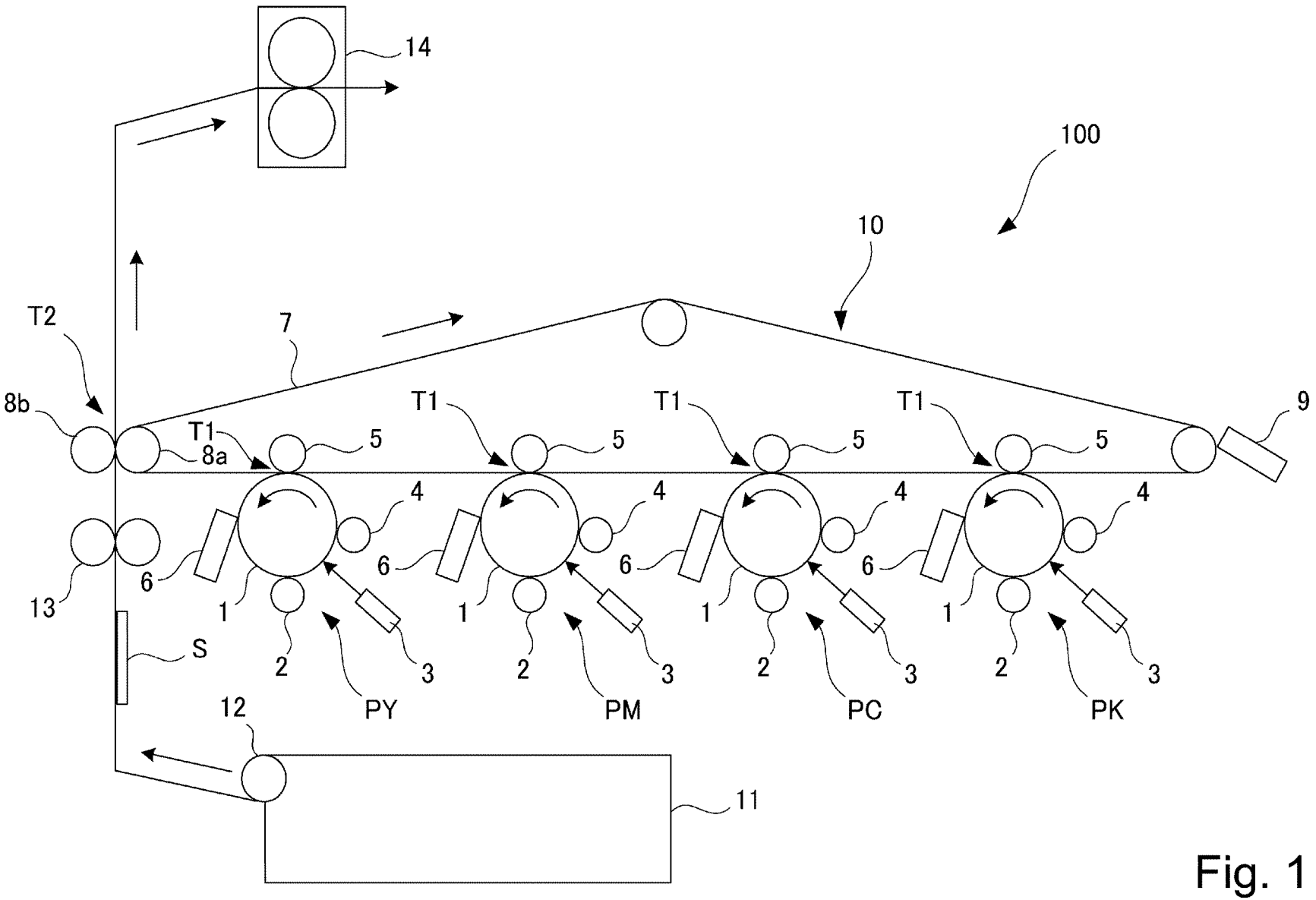
FIG. 1 is a schematic view of an image forming apparatus according to the present invention.

In the following, an embodiment for carrying out the present invention will be described with reference to the drawings. FIG. 1 is a schematic view showing a structure of an image forming apparatus 100 according to this embodiment. The image forming apparatus 100 is a laser beam printer of an intermediary transfer type in which four process cartridges PY, PM, PC and PK and an intermediary transfer belt 7 are provided.

Each of the process cartridges PY to PK includes a photosensitive drum 1, a charging device 2, a laser scanner 3, a developing device 4 and a drum cleaner 6, and the process cartridges to PY to PK are capable of are capable of forming toner images of colors of yellow, magenta, cyan and black, respectively. That is, the charging device 2 electrically charges a surface of the photosensitive drum 1 which is a photosensitive member uniformly, and the laser scanner 3 writes (forms) an electrostatic latent image on the photosensitive drum 1 by irradiating the photosensitive drum surface with laser light modulated depending on image information. The developing device 4 develops the electrostatic latent image into a toner image by supplying charged toner to the photosensitive drum 1. Further, each of the process cartridges PY to PK is constituted as a unit mountable in and dismountable from a casing of the image forming apparatus 100. However, the laser scanner 3 is not included in the cartridge and is assembled separately with the image forming apparatus in some cases.

A transfer unit 10 which is a transfer means in this embodiment includes the intermediary transfer belt 7 which is an intermediary transfer member and a plurality of rollers for stretching the intermediary transfer belt 7. The toner images formed by the process cartridges PY to PK are primary-transferred at primary transfer portions T1 by primary transfer rollers 5. At this time, the toner images of four colors are transferred superposedly, so that a full-color toner image is formed on the intermediary transfer belt 7. The toner image carried on the intermediary transfer belt 7 is conveyed with rotation of the intermediary transfer belt 7 toward a secondary transfer portion T2 formed between an inner secondary transfer roller 8*a* and an outer secondary transfer roller 8*b*. A deposited matter such as the toner remaining on the photosensitive drum 1 without being transferred onto the intermediary transfer belt 7 is removed by the drum cleaner 6.

In parallel to such a toner image forming process, a recording material S is fed from a cassette 11. A registration roller pair 13 sends the recording material S toward the secondary transfer portion T2 at timing synchronized with a progress of the toner image forming process by the process cartridges PY to PK. The toner image carried on the intermediary transfer belt 7 is secondary-transferred onto the recording material S at the secondary transfer portion T2. A deposited matter such as the toner remaining on the intermediary transfer belt 7 without being transferred onto the recording material S is removed by a belt cleaner 9.

The recording material S which passes through the secondary transfer portion T2 and on which an unfixed toner image is transferred is conveyed to a fixing device 14. The fixing device 14 includes a roller pair for sandwiching and feeding the recording material S and a heat generating member such as a halogen heater for heating the image on the recording material S through the roller pair, and fixes the toner image on the recording material S under application of heat and pressure. The recording material S passes through the fixing device 14 is discharged to an outside of the casing of the image forming apparatus 100.

<Photosensitive Drum>

In the following structural examples of the respective portions of the image forming apparatus 100 will be described. The photosensitive drum 1 which is an image bearing member in this embodiment is a rotatable drum-type organic electrophotographic photosensitive member has a constitution in which on a surface of an aluminum cylinder (electroconductive drum substrate), a charge generation layer and a charge transporting layer (thickness: about 20 μm) which comprise organic materials are applied in a named order. Further, a surface layer of the photosensitive drum 1 is a cured layer using a curable resin as a binder resin. The photosensitive drum 1 is 340 mm in length in an axial direction (longitudinal direction) and is 30 mm in outer diameter, and is rotationally driven in an arrow direction in FIG. 1 at a process speed (peripheral speed) of 200 mm/sec.

Incidentally, in place of the above-described cured layer, a charge transporting cured layer formed by curing and polymerizing a monomer having a C—C double bond and a charge transporting monomer having a C—C double bond by heat or light energy may also be used as the surface layer. A charge transporting cured layer formed by curing and polymerizing a hole transporting compound having a chain-polymerizable functional group in the same molecule by electron beam energy may also be used as the surface layer. Further, a photosensitive drum 1 including no cured layer can also be used.

<Charging Roller>

The charging device 2 which is a charging means in this embodiment has a constitution of a contact charging type including a charging roller. The charging roller is a roller of 330 mm in length in an axial direction and 14 mm in diameter, for example, and has a constitution in which an electroconductive rubber layer is formed around a core metal made of stainless steel. This charging roller is rotatably held by bearing members at opposite end portions of the core metal thereof and is urged toward the photosensitive drum 1 by urging springs, so that the charging roller is contacted to the surface of the photosensitive drum 1 with a predetermined urging force. As a result, the charging roller is rotated by rotation of the photosensitive drum 1.

The charging device 2 supplies electric charges to the drum surface by utilizing an electric discharge phenomenon generating in a minute gap between the charging roller and the photosensitive drum 1. To the core metal of the charging roller, a charging voltage is applied from a voltage source mounted in the image forming apparatus 100. As the charging voltage, for example, a voltage in the form of a DC voltage of −500 V biased with an AC voltage can be used. In this case, when an amplitude of the AC voltage is set at a value twice or more a discharge start voltage in an environment thereof, the surface of the photosensitive drum 1 can be electrically charged uniformly to about −500 V. incidentally, the DC voltage applied during the image formation is not limited to this value, but may appropriately be adjusted depending on an environment in which the image forming apparatus is installed and cumulative operation times of the photosensitive drum 1 and the charging roller.

<Laser Scanner>

The laser scanner 3 modifies and outputs laser light on the basis of a video signal transmitted from a controller of the image forming apparatus 100, and writes (forms) an electrostatic latent image on the surface of the photosensitive drum 1 by irradiating the charged photosensitive drum surface with the laser light. The controller forms the video signal on the basis of image information acquired by an image reading device provided integrally with the image forming apparatus 100 or image information received from a host device connected to the image forming apparatus 100 through a network. In a surface region of the photosensitive drum 1 irradiated with the laser light, electric charges generated in the charge generating layer are transported through the charge transporting layer and thus a surface potential lowers, so that the electrostatic latent image corresponding to the image information is written (formed) on the drum surface.

<Developing Device>

The developing device 4 which is a developing means in this embodiment includes a developing sleeve which is a developer carrying member, and supplies the toner from the developing sleeve toward the photosensitive drum 1. A length of the developing sleeve in the longitudinal direction is set at 325 mm, for example. As the developer, a two-component developer comprising toner and a carrier is used. In this case, the carrier is attracted to the sleeve surface by a magnet provided inside the developing sleeve, so that a magnetic brush in which carrier particles coated with the toner are connected with each other in a brush shape is formed. Then, a predetermined bias voltage is applied to the developing sleeve, whereby the toner is transferred from the developing sleeve onto the surface of the photosensitive drum 1 depending on a potential distribution of the photosensitive drum surface, and thus the drum-shaped electric latent image is developed into the toner image.

As the toner, toner obtained by kneading a pigment in a resin binder principally comprising polyester and then by pulverizing and sieving the kneaded product and which has an average diameter of about 6 μm is used. An average charge amount of the toner deposited in the photosensitive drum 1 is about −30 μC/g. As the bias voltage applied to the developing sleeve, an oscillating voltage in the form of a DC voltage of the same polarity as a normal charge polarity of the toner biased with an AC voltage of a rectangular wave of 8.0 kHz in frequency and 1.8 kV in peak-to-peak voltage is used. The DV voltage is set so that the toner is not deposited (i.e., a fog image is generated) on a non-exposure region of the photosensitive drum 1.

<Primary Transfer Roller>

The primary transfer roller 5 is press-contacted to the intermediary transfer belt 7 toward the photosensitive drum 1 with a predetermined urging force, and forms the primary transfer portion T1 as a nip between the intermediary transfer belt 7 and the photosensitive drum 1. To the primary transfer roller 5, a transfer voltage (for example, a voltage of +600 V) of an opposite polarity (positive polarity) to the normal charge polarity of the toner is applied. As a result, the toner images carried on the photosensitive drums 1 are successively electrostatically transferred onto the surface of the intermediary transfer belt 7.

<Intermediary Transfer Belt>

As the intermediary transfer belt 7, an endless belt having a two-layer structure consisting of a base layer and a surface layer. As a resin material constituting the base layer, polycarbonate or a fluorine-containing resin material such ETFE (ethylene-tetrafluoroethylene copolymer) or PVDF (polyvinylidene difluoride) can be used. A material of the surface layer is not particularly limited, but it is required that the material reduces a depositing force on the belt surface and enhances transfer efficiency at the secondary transfer portion T2. For example, polyurethane or polyester can be used. In the base layer, a resistance value-adjusting electroconductive agent is added as needed. This resistance value-adjusting electroconductive agent is not particularly limited, but for example, carbon black, graphite or the like may be used. For example, as the base layer, a 100 μm-thick layer which has surface resistivity of $10^{12}$ Ω/square (measured using a probe according to JIS-K6911 under a condition of an applied voltage of 100 V and an application time of 60 sec in an environment of 23° C./(50% RH) and which is made of PI (polyimide).

<Cleaning Blade>

Figure 2:
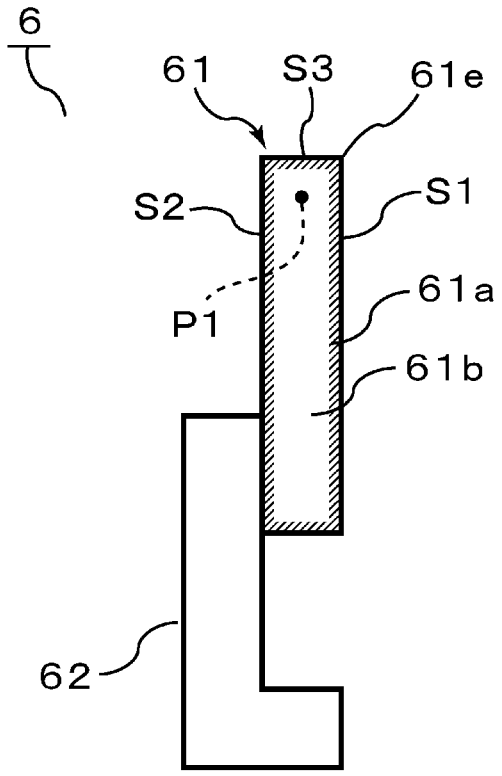
FIG. 2 is a schematic view of a cleaning blade according to the present invention.

FIG. 2 is a schematic view of the drum cleaner 6 in this embodiment. The drum cleaner 6 is constituted by a cleaning blade 61 which is a cleaning blade according to the present invention and a metal plate member 62 supporting the cleaning blade 61. The cleaning blade 61 is a plate-like rubber comprising an urethane rubber as a base material and is fixed to the metal plate member 62 with an adhesive. The cleaning blade 61 contacts the photosensitive drum 1 at an edge 61*e* and scrapes off a foreign matter on the drum surface with rotation of the photosensitive drum 1. When opposite side surfaces of the cleaning blade 61 are a first surface S1 and a second surface S2 and when a surface connecting the first surface S1 and the second surface S2 with respect to a thickness direction on a free end side is an end surface S3, the edge 61*e* is an edge line portion formed by the first surface S1 and the end surface S3.

The cleaning blade 61 is formed on a length of 330 mm in an axial direction (the longitudinal direction of the photosensitive drum 1), for example, and is urged against the photosensitive drum 1 at linear pressure (contact pressure at the edge 61*e*) in a range from 20 gf/cm to 50 gf/cm. In the case where the linear pressure is smaller than 20 gf/cm, a degree of contact between the cleaning blade 61 and the photosensitive drum 1 becomes insufficient, so that improper cleaning in which the foreign matter on the drum surface cannot be caught by the edge 61*e* and slips through the cleaning blade 61 is liable to occur. On the other hand, in the case where the linear pressure is larger than 50 gf/cm, a frictional force acting between the cleaning blade 61 and the photosensitive drum 1 increases, and problems such as shuddering (vibration) of the blade, abrasion of the blade and breakage of the blade are liable to arise, so that there is a possibility that a good cleaning property cannot be obtained.

The cleaning blade 61 is disposed so as to contact the photosensitive drum 1 from a counter direction. That is, the cleaning blade 61 is supported by the metal plate member 62 in an attitude in which with respect to a direction of a normal to the drum surface at the contact portion with the photosensitive drum 1, the cleaning blade 61 is inclined so as to extend toward an upstream side of the drum with respect to a rotational direction of the drum with a decreasing distance toward the free end of the blade (see also FIG. 1).

Incidentally, in this embodiment, the drum cleaner 6 was described, but the constitution of the cleaning blade 61 is also applicable to a cleaning blade of the belt cleaner 9 for cleaning the intermediary transfer belt 7. That is, the intermediary transfer belt 7 is another example of the image bearing member.

<Surface Treatment of Cleaning Blade>

The cleaning blade 61 in this embodiment includes a base layer 61*b* and a surface treated layer 61*a* harder than the base layer 61*b*. The surface treated layer 61*a* refers to a layer, subjected to surface treatment, of the cleaning blade 61 comprising polyurethane as a base material. The base layer 61*b* refers to a layer which has not been subjected to the surface treatment (i.e., a layer which is not affected by the surface treatment in terms of a physical property such as elastic modulus and which is regarded as a layer on which the influence of the surface treatment is sufficiently weak). A determining method of a boundary between the base layer 61*b* and the surface treated layer 61*a* (i.e., a thickness of the surface treated layer) will be described later.

By providing the surface treated layer 61*a*, it is possible to not only maintain a cleaning performance over a long term by improving an anti-wearing property of the cleaning blade 61 but also decrease a torque of the photosensitive drum 1. However, a sliding property between the photosensitive drum 1 and the cleaning blade 61 is remarkably different between a central portion and opposite end portions with respect to the longitudinal direction of the photosensitive drum 1. That is, at the central portion of the photosensitive drum 1, the toner and an additive added to toner particles, which have the function as a lubricant are supplied to the contact portion between the photosensitive drum 1 and the cleaning blade 61, and therefore, the sliding property is maintained in a relatively high state. On the other hand, in regions of the opposite end portions of the photosensitive drum 1, a supply amount of these particles is remarkably small, so that the cleaning blade 61 is in a condition that the cleaning blade 61 is liable to adhere to the surface of the photosensitive drum 1. Accordingly, even when the surface treated layer 61*a* is provided, there is a possibility that curling-up of the blade occurs from the longitudinal end portions as a starting point.

Therefore, the cleaning blade 61 in this embodiment is subjected to, in addition to treatment for entirely curing the end surface S3 (first surface treatment), treatment for curing only the opposite end portions with respect to the longitudinal direction (second surface treatment). In the following, contents of the first surface treatment and the second surface treatment will be described. In the following description, the plate-shaped member which is prepared by molding the urethane rubber in a blade shape and which is in a state before being subjected to the surface treatment is distinguished from the cleaning blade 61 which has been subjected to the first surface treatment and the second surface treatment and which is capable of being assembled in the image forming apparatus 100, and is referred to as a "molded blade member". That is, the cleaning blade 61 of this embodiment is manufactured by subjecting the blade surface to curing treatment through the first surface treatment and the second surface treatment after a molding step in which the molded blade member is prepared by molding.

<First Surface Treatment>

In the first surface treatment which is a first treatment step in this embodiment, the surface treatment of the blade surface is carried out so that the blade surface at least includes an entirety of the end surface S3 of the cleaning blade 61 (for example, an entirety of the surface of the cleaning blade 61 including the first surface S1 and the second surface S2 is subjected to the surface treatment). As a method of the first surface treatment, a method in which the blade surface is impregnated with a surface treatment liquid containing a curable composition of an isocyanate compound or an ultraviolet curable resin material is used.

As the surface treatment liquid of the first surface treatment, a mixed solution of a difunctional isocyanate compound (A), a trifunctional polyol (B) and an organic solvent or a mixed solution of a prepolymer, obtained by reaction of (A) and (B), with the organic solvent can be suitably used. The prepolymer itself is an isocyanate compound having a terminal isocyanate group. These surface treatment liquids are appropriately prepared in consideration of wettability to the molded blade member, a degree of immersion and an effective period of the surface treatment liquid. Further, after immersion of the molded blade member in the surface treatment liquid, curing reaction is caused to proceed by placing the molded blade member in an environment in which a temperature and a humidity are maintained at certain values after the immersion thereof in the surface treatment liquid.

A ratio of an isocyanate group contained in the difunctional isocyanate compound to a hydroxyl group contained in the trifunctional polyol in the surface treatment liquid (NCO group/OH group) may preferably be 1.0 or more and 1.5 or less. When this ratio is smaller than 1.0, there is a possibility that an unreacted polyol remains and causes whitening and softening. Further, when the ratio is larger than 1.5, there is a possibility that an unreacted isocyanate remains and causes a change in color to brown. When these phenomenon occur, a surface treatment layer having high hardness and high sliding property cannot be obtained, so that a good cleaning property and a good anti-wearing property cannot be obtained in some cases.

As the curable composition, by using the mixture of the difunctional isocyanate compound and the trifunctional polyol or using the prepolymer obtained by reaction of these compounds, it is possible to obtain a surface which is capable of improving the anti-wearing property and which has high hardness and a high sliding property while suppressing the thickness of the surface treated layer 61*a*. This is because by using the above-described composition, cross-linking of the polyurethane efficiently proceeds and thus the surface treated layer 61*a* having a high cross-linking density is formed at a surface layer portion of the molded blade member. Further, desired hardness can be achieved without using the surface treatment liquid containing the curable composition with a high concentration, and therefore, the isocyanate compound is not excessively applied onto the surface of the molded blade member, so that a step of removing the isocyanate compound in an excessive amount can be omitted.

Elastic modulus (in this embodiment, indentation elastic modulus measured by an indentation test (hereinafter, also referred to as Young's modulus)) of the surface treated layer 61*a* formed by the first surface treatment may preferably be 40 MPa or less. When the elastic modulus is larger than 40 MPa, the surface treated layer 61*a* cannot follow deformation of the base layer 61*b*, so that breakage of the surface treated layer 61*a* is liable to occur.

The elastic modulus of the base layer 61*b* may preferably be 3 MPa or more and 20 MPa or less, more preferably be 5 MPa. Incidentally, the elastic modulus of the base layer 61*b* is elastic modulus of the base material which has not been subjected to the surface treatment. As the elastic modulus of the base layer 61*b*, a value measured at a position (at a depth of 1000 μm from the end surface S3) sufficiently apart from the end surface S3 in a cross-section perpendicular to the end surface S3 and at an intermediary position P1 (FIG. 2) between the first surface S1 and the second surface S2 with respect to the thickness direction is employed. In the case where the elastic modulus of the base layer 61*b* is less than 3 MPa, it is difficult to set the contact pressure of the cleaning blade 61 to the photosensitive drum 1 at a value suitable to ensure the cleaning performance. Further, when the elastic modulus of the base layer 61*b* is smaller than 3 MPa, a driving load of a member-to-be-contacted increases and as a result, a filming suppressing effect lowers in some cases. Filming refers to a phenomenon that a deposited mater such as the toner is deposited in the form of a film on the surface of the photosensitive drum 1. On the other hand, when the elastic modulus of the base layer 61*b* is larger than 20 MPa, a sufficient intimate contact property between the photosensitive drum 1 and the cleaning blade 61 cannot be obtained.

A difference between the elastic modulus of the surface treated layer 61*a* and the elastic modulus of the base layer 61*b* may preferably be 1 MPa or more, more preferably be 3 MPa or more. By setting the elastic modulus of the surface treated layer 61*a* so as to be at least 1 MPa than the elastic modulus of the base layer 61*b*, the anti-wearing property is effectively improved, so that the performance of the cleaning blade 61 can be maintained for a long term.

In summary, indentation elastic modulus $E_0$ in the case where the elastic material which is the base material of the cleaning blade 61 has not been subjected to the surface treatment and indentation elastic modulus $E_1$ of the blade surface subjected to the first surface treatment are set so as to satisfy the following relationships.

$E_0$ [MPa]: 3 or more and 20 or less (preferably 5 or more)

$E_1$ [MPa]: ($E_0$+1) or more and 40 or less (preferably be ($E_0$+3) or more)

A value of the indentation elastic modulus is measured using a Dynamic Ultra Micro Hardness Tester (manufactured by Shimadzu Corp.) by a loading-unloading test according to ISO14577 in a condition of a retention time of 5 sec, a maximum test load of 0.98 N and a load speed of 0.14 N/sec. As a measuring sample, a test piece cut from a rubber sheet prepared under the same condition as a condition for a rubber sheet for preparing the cleaning blade 61 through molding is used. The indentation elastic modulus of the blade surface cured by the first surface treatment can be measured using a rubber sheet subjected to the surface treatment by using the same surface treatment liquid and curing condition as those in the first surface treatment. In this case, a test piece is cut in a dimension of 40 mm×12 mm from a central portion of the surface-treated rubber sheet and is fixed on a slide glass by a double-side tape with a mirror surface (a surface on an opposite side from a mold surface side during centrifugal molding of the rubber sheet) upward, and then is left standing for 30-40 minutes in a constant temperature oven set at 23° C. Thereafter, the indentation elastic modulus of the measuring sample is measured at 20 points disposed at the longitudinal central portion of the measuring sample and at positions separated 30 μm from an edge line which is a long side width intervals of 30 μm in parallel to the edge line with respect to the longitudinal direction, and an average of 20 measured values is taken as a measured value. Incidentally, the indentation elastic modulus of the base layer 61*b* is measured by a similar measuring method by using the test piece cut from the rubber sheet which has not been subjected to the surface treatment.

A thickness (first depth) of the surface treated layer 61*a* formed by the first surface treatment may preferably be 10 μm or more and 100 μm or less, more preferably be 10 μm or more and 50 μm or less.

A cross-sectional hardness of the cleaning blade 61 subjected to the first surface treatment and subsequent second surface treatment described below continuously changes with a depth from the end surface S3 in general. The first depth and a treatment depth (second depth) of the second surface treatment can be measured using the Dynamic Ultra Micro Hardness Tester (manufactured by Shimadzu Corp.) by the following method according to JIS Z2255 and ISO14577. First, as regards the base layer 61*b*, dynamic hardness described later is measured in advance. Then, a cross-section of the surface-treated molded blade member is cut out, and then a change in hardness from a surface layer of the cross-section toward an inside of the molded blade member is measured. The hardness at a position of a distance of 10 μm (depth of 10 μm) from the surface is a reference value, and a layer in a range in which a change amount of the measured value relative to the reference value is 30% or less is the surface treated layer 61*a*. That is, the thickness of the surface treated layer 61*a* refers to a maximum depth of a portion where when a measured value at the develop of 10 μm from the surface is a reference value in the case where the dynamic hardness of the cut surface perpendicular to the surface subjected to the surface treatment is measured, the measured value is 70% or more of the reference value.

<Second Surface Treatment>

In the second surface treatment which is a second treatment step in this embodiment, as regards the end surface S3 of the molded blade member, only opposite end portions with respect to the longitudinal direction of the photosensitive drum 1 are cured. As a specific treatment method of the second surface treatment, it is possible to cite the following steps (1) to (4):

(1) a step of bringing an isocyanate compound into contact with the longitudinal opposite end portions on the end surface S3 of the molded blade member, (2) a step of impregnating the molded blade member with the isocyanate compound after the isocyanate compound is left standing for a predetermined time in a contact state with the molded blade member, (3) a step of removing the isocyanate compound remaining on the surface of the molded blade member after impregnation of the isocyanate compound, and (4) a step of causing a curing reaction to proceed by reaction of the isocyanate compound with which the molded blade member is impregnated.

By the steps (1) and (2), the molded blade member impregnated with the isocyanate compound is regions of the opposite end portions of the end surface S3 thereof. By the step (3), an excessive isocyanate compound is removed. Then, by the step (4), the reaction of the isocyanate compound proceeds inside or at the surface of the molded blade member, so that it is possible to obtain a surface further harder than the surface cured by the first surface treatment.

In the second surface treatment, the depth (second depth) at which the molded blade member is impregnated with the isocyanate compound is set at 100 or more and 500 μm or less from the end surface S3. For example, the predetermined time (impregnation time of the isocyanate compound) of the above-described step (2) may preferably be 5 minutes or more, further preferably be 10 minutes or more. In such a condition, by sufficiently impregnating the molded blade member with the isocyanate compound, it is possible to obtain a blade surface which has further high hardness and further high sliding property compared with those by the first surface treatment.

In the step (3), the isocyanate compound remaining on the blade surface can be wiped off using a solvent capable of dissolving the isocyanate compound. In the step (4), it would be considered that opposite end-treated portions 61*c* are formed by reaction of polyurethane, which is the base material of the molded blade member, with the isocyanate compound. That is, urethane bond having active hydrogen exists in the polyurethane resin material constituting the molded blade member, and in the step (4), this urethane bond and the isocyanate compound with which the molded blade member is impregnated react with each other, so that allophanate bond is formed. Further, it would be considered that oligomerization (multimerization) reaction (for example, carbodiimidization reaction, isocyanuration reaction or the like) based on reaction between isocyanate compounds also proceeds simultaneously and contributes to formation of the opposite end-treated portions 61*c*. The isocyanate compound with which the molded blade member is impregnated by the steps (1) and (2) reacts with the polyurethane and forms the allophanate bond, or most of the isocyanate compound is consumed by reaction with water content in the air, so that a white opaque treated layer is formed.

In the following, of the surface treated layer 61*a* of the cleaning blade 61 which is finally obtained, portions subjected to the second surface treatment are referred to as the opposite end-treated portions 61*c* and 61*c* (part (a) of FIG. 3). Further, of the end surface S3 of the cleaning blade 61, a region subjected to only the first surface treatment is referred to as a first region A1, and regions subjected to both the first surface treatment and the second surface treatment are referred to as second regions A2 and A2. The first region A1 includes a central position of the end surface S3 with respect to the longitudinal direction, and the second regions A2 and A2 are disposed on one side and on the other side, respectively, of the first region A1.

A treatment condition of the second surface treatment is set so that dynamic hardness DH2 [mN/μm$^2$] of the second region A2 is 0.15 or more and 0.50 or less, preferably be 0.20 or more and 0.40 or less. In the case where the dynamic hardness DH2 of the second region A2 is less than 0.15 [mN/μm$^2$], friction between the longitudinal end region of the edge 61*e* and the photosensitive drum 1 cannot be sufficiently reduced, so that there is a possibility that curling-up of the cleaning blade 61 occurs. Further, in the case where the dynamic hardness DH2 of the second region is larger than 0.50 [mN/μm$^2$], flexibility (toughness) of the opposite end-treated portions 61*c* in the neighborhood of the surface layer is lost and thus the edge 61*e* is liable to break, so that there is a possibility that slipping-through of the toner occurs.

On the other hand, dynamic hardness DH1 [mN/μm$^2$] of the first region A1 in which the blade surface is subjected to only the first surface treatment is set in a range of 0.10 or more and 0.20 or less. In the case where the dynamic hardness DH1 of the first region A1 is less than 0.10 [mN/μm$^2$], a contact area between the cleaning blade 6) and the photosensitive drum 1 is liable to extend. As a result, contact pressure suitable for cleaning is not readily ensured, so that there is a possibility that improper cleaning occurs. On the other hand, in the case where the dynamic hardness DH1 of the first region A1 is larger than 0.20 [mN/μm$^2$], a fluctuation range of the contact pressure relative to a change in penetration amount of the cleaning blade 61 becomes large. The penetration amount of the cleaning blade 61 represents an interference range between the edge 61*e* and a surface of the member-to-be-contacted (the photosensitive drum 1 in this embodiment) on assumption that the cleaning blade 61 and the member-to-be-contacted are rigid members. In the case where the fluctuation range of the contact pressure relative to the change in penetration amount is large, the cleaning property lowers when a mounting position and a mounting attitude of the cleaning blade 61 are deviated even slightly, and therefore, design latitude and ease of assembling of the cleaning device are impaired.

Further, a dynamic hardness difference (DH2−DH1) which is a difference between the dynamic hardness DH1 of the first region A1 and the dynamic hardness DH2 of the second region A2 is 0.05 [mN/cm$^2$] or more. By making such setting, it is possible to effectively reduce a degree of the curling-up of the cleaning blade 61 from the longitudinal end portion as a starting point while setting the hardness of the first region A1 at hardness suitable to ensure the cleaning performance.

Here, the dynamic hardness DH is a parameter acquired by dividing an indentation load when an indenter is pressed in a sample, by an indenter area corresponding to an indentation depth and is represented by $DH=\alpha \times P/D^2$, where P represents the indentation load (mN), D represents the indentation depth (μm) of the indenter pressed in the sample, and a is a constant ($\alpha$=3.8584 as an example) determined depending on a shape of the indenter. This hardness can be measured by a measuring device ("FISCHERSCOPE HM2000 LT", manufactured by Fischer Instruments K.K.) with use of a measuring indenter ("HM2000 060"). As an example of a measuring condition, a condition in which a measuring load of 10 mN, a load increasing time of 20 sec, a creep of 5 sec, a load decreasing time of 20 sec, and a creep of 5 sec.

As the curable composition with which the molded blade member is impregnated, it is possible to use an isocyanate compound having at least one isocyanate group in (one) molecule. As the isocyanate compound having one is isocyanate group in molecule, it is possible to use an aliphatic monoisocyanate such as octadecy isocyanate (ODI), an aromatic monoisocyanate, and the like. As the isocyanate compound having two or more isocyanate groups in molecule, it is possible to use 2,4-trylene diisocyanate, 2,6-trylene diisocyanate, 4,4'-diphenylmethane diisocyanate (MDI), m-phenylene diisocyanate, tetramethylene diisocyanate, hexamethylene diisocyanate, and the like. Further, the molded blade member may also be impregnated with a catalyst for accelerating the reaction of the isocyanate compound, in addition to the isocyanate compound.

The impregnation of the blade with the isocyanate compound can also be performed by using, e.g., a method in which a fibrous member or a porous member is impregnated with the isocyanate compound and then is applied onto the blade or a method in a treatment liquid in which the isocyanate compound is dispersed in a solvent is spray-coated on the blade, or the like method. A length of the predetermined time (impregnation time of the isocyanate compound) and setting of widths of the first region A1 and the second regions A2 and A2 in the step (2), and the like can be appropriately changed depending on an operation condition (for example, a size or hardness of the photosensitive drum 1).

<Range of Surface Treatment>

A range in which the second surface treatment is performed will be described using part (a) of FIG. 3. Part (a) of FIG. 3 shows a positional relationship, with respect to the longitudinal direction of the photosensitive drum 1, among the photosensitive drum 1, the developing sleeve 4*a* of the developing device, the charging roller 2*a* of the charging device, and the cleaning blade 61 of the drum cleaner.

Both of a developer carrying region X2 in which the developing sleeve 4*a* is capable of carrying the developer (this region is also called a coating region and a charging region X3 in which the charging roller 2*a* electrically charges the photosensitive drum 1 are broader than an image forming region X1 of the photosensitive drum 1 and include the image forming region X1 with respect to the longitudinal direction. These positional relationship meet demands that an entirety of a range in which the electrostatic latent image is capable of being formed is chargeable and that a maximum-size electrostatic latent image capable of being formed on the photosensitive drum 1 is capable of being developed. Here, the image forming region X1 refers to a region where the toner image is capable of being formed on the photosensitive drum 1 in a normal operation condition (a region where the laser scanner is capable of writing the electrostatic latent image). Further, the developer carrying region X2 in this embodiment corresponds to a range, from one end to the other end with respect to the longitudinal direction, of the magnet generating a magnetic field for attracting the developer to the developing sleeve 4*a*.

The charging region X3 is broader than the developer carrying region X2 and includes the developer carrying region X2 with respect to the longitudinal direction. This is because a range broader than the developer carrying region X2 is charged to the same polarity as the normal charge polarity in the charging step and thus the drum surface is prevented from being contaminated with the toner deposited on the photosensitive drum 1 on an outside of the image forming region. Incidentally, also in portions of the charging region X3 outside the developer carrying region X2, there is a possibility that the toner is slightly deposited on the photosensitive drum 1, and therefore, the length of the cleaning blade 61 is set so as to be longer than the charging region X3.

As regards the end surface S3 of the cleaning blade 61, the first region A1 is set so that the first region A1 is broader than the image forming region X1 and includes the image forming region X1 with respect to the longitudinal direction, and the second regions A2 and A2 are disposed outside the first region A1. That is, boundary positions B1 and B1 each between the first region A1 and the associated second region A2 are disposed outside the image forming region X1. As a result, a shape and hardness of the end surface S3 of the cleaning blade 61 are constant inside the image forming region X1, and therefore, slipping through of the toner and the like are prevented, so that a stable cleaning performance is exhibited. However, each of the boundary positions B1 and B1 each between the first region A1 and the associated second region A2 refers to a point which provides an intermediate value of average hardness of the first region A1 and average hardness of the second region A2 in the case where the dynamic hardness of the end surface S3 is measured at a plurality of measuring points disposed along the longitudinal direction.

Further, the boundary positions B1 and B1 each between the first region A1 and the associated second region 2 are positioned inside the developer carrying region X2. In the case where the boundary positions B1 and B1 are positioned outside the developer carrying region X2, a part of the first region A1 which is not subjected to the second surface treatment contacts the photosensitive drum 1 on the outside of the developer carrying region X2. To this contact portion, the toner and the additive which constitute the lubricant are little supplied, and therefore, there is a possibility that this contact portion is a starting point of the curling-up of the blade. On the other hand, in this embodiment, the boundary positions B1 and B1 are positioned inside outside ends of the developer carrying region X2, and therefore, the curling-up of the blade can be avoided further reliably.

Incidentally, in the case where the cleaning blade 61 of this embodiment is used as a cleaning blade for cleaning the intermediary transfer belt 7, a constitution in which the above-described positional relationships are satisfied in a state in which the photosensitive drum 1 is replaced with the intermediary transfer belt 7 and the charging roller 2*a* is replaced with the primary transfer roller 5 is employed.

<Compatible Realization of Prevention of Curling-Up of Blade and Slipping-Through of Toner>

Incidentally, in the second surface treatment, a stepped portion (step height) of the edge 61*e* generates at the boundary position B1 between the first region A1 and the second region A2 as shown in part (b) of FIG. 3 due to swelling of a portion constituting the end-treated portion 61*c* by impregnation of the isocyanate compound. That is, a dimension (thickness) Z1, with respect to a thickness direction Z, of the end surface S3 in the first region A1 and a dimension (thickness) Z2, with respect to the thickness direction Z, of the end surface S3 in the second region A2 are different from each other (Z2>Z1), so that the position of the edge 61*e* with respect to the thickness direction Z is shifted. There is a possibility that such a stepped portion (step height) of the boundary portion (hereinafter referred to as a boundary step height) causes the slipping-through the toner leading to improper cleaning, and therefore, the stepped portion (step height) may preferably be as small as possible. For example, the difference (Z2−Z1) between the dimensions Z1 and Z2 which define a magnitude of the boundary step height may preferably be 25 μm or less, more preferably be 15 μm or less. By employing such a constitution, it is possible to provide the cleaning blade capable of not only suppressing the curling-up of the blade but also reducing the slipping through of the toner.

Here, a degree of swelling of the opposite end-treated portions 61*c* by the second surface treatment is influenced by the hardness of the end surface S3 of the molded blade member in a state before the molded blade member is subjected to the second surface treatment. One of causes of this is that the end surface S3 directly contacts the surface treatment liquid, and different from an inside region of the blade, there is no delay until a component of the treatment liquid reaches the end surface S3 and therefore the end surface S3 is exposed to the treatment liquid. Further, a rubber texture of the molded blade member exposed to the end surface S3 is, different from an inside texture of the molded blade member, not limited in deformation by elasticity of a texture closer to the end surface S3, but is in a condition in which the texture is relatively liable to be elongated.

FIG. 4 shows a relationship between dynamic hardness (abscissa) of the molded blade member which is not subjected to the second surface treatment and an index (ordinate) indicating ease of swelling of the opposite end-treated portions 61*c* by the second surface treatment. As the index indicating the ease of swelling, a value obtained by dividing the boundary step height (Z2−Z1) after the second surface treatment by a difference between dynamic hardness before the second surface treatment and dynamic hardness after the second surface treatment (i.e., A dynamic hardness) is employed. Further, respective points in FIG. 4 represent a result of calculation of the index by subjecting a plurality of samples different in dynamic hardness to the second surface treatment.

From FIG. 4, it is understood that a downward-sloping correlation showing that the opposite end-treated portions 61*c* do not readily swell with increasing dynamic hardness of the molded blade member before the second surface treatment. This is because the texture of the molded blade member does not readily elongate, relative to swelling pressure by impregnation of the treatment liquid, with increasing dynamic hardness of the molded blade member before the second surface treatment.

Accordingly, in order to prevent the slipping-through of the toner by decreasing the boundary step height, it is preferable that the molded blade member is first subjected to the first surface treatment and then subjected to the second surface treatment. As a result, in the second surface treatment, the blade surface in a cured state by the first surface treatment is impregnated with the treatment liquid, so that compared with the case where an uncured blade surface is impregnated with the treatment liquid, the swelling of the opposite end-treated portions 61*c* is alleviated.

Incidentally, as another method of decreasing the boundary step height while enhancing the hardness and sliding property of the opposite end-treated portions 61*c*, it would be also considered that as the base material of the molded blade member, a material having high dynamic hardness is selected. However, in the case where such hard material is used, there is a need to pay attention to that breakage of the blade is liable to occur and that a fluctuation range of the contact pressure relative to a change in penetration amount of the cleaning blade 61 becomes large and thus design latitude lowers. According to this embodiment, even in the case where a relatively soft material is used as the base material of the cleaning blade 61, it is possible to decrease the boundary step height while enhancing the hardness and sliding property of the opposite end-treated portions 61*c*.

Further, in this embodiment, a treatment depth (first depth) of the first surface treatment is set so as to be shallower than a treatment depth (second depth) of the second surface treatment. As described above, the hardness of the end surface S3 before the second surface treatment relates to a magnitude of the boundary step height, and therefore, even when the treatment depth of the first surface treatment is set so as to be shallower than the treatment depth of the second surface treatment, it is possible to suppress the boundary step height. Accordingly, the treatment depths of the first surface treatment and the second surface treatment are independently settable in consideration of a standard such as the dynamic hardness required for each of the first region A1 and the second regions A2 of the cleaning blade 61.

<Evaluation of Cleaning Blade>

Table 1 appearing hereinafter provides a summary of a result of an evaluation test of performances of the cleaning blade 61 according to this embodiment.

In Embodiment 1, a cleaning blade according to the constitution of this embodiment described above is prepared by subjecting a molded blade member made of an urethane rubber to the first surface treatment and the second surface treatment in a named order. In the second surface treatment, the molded blade member was left standing for 60 minutes in an environment of 24° C. in a state in which the isocyanate compound was contacted to the molded blade member. When a resultant end surface S3 of the blade was observed through an optical microscope, the boundary step height was 11 μm. In the case where the dynamic hardness was measured using Vickers indenter with a face angle of 136 degrees, the dynamic hardness DH1 of the end surface S3 in the first region A1 was 0.13 [mN/μm$^2$], and the dynamic hardness DH2 of the end surface S3 in the second regions A2 was 0.32 [mN/μm$^2$]. Further, the thickness (first depth) of the surface treated layer 61*a* in the first region A1 was 30 μm, and the thickness (second depth) of the opposite end-treated portions 61*c* was 300 μm.

In Comparison Example 1, a cleaning blade which is not subjected to the second surface treatment after the first surface treatment was prepared. In Comparison Example 1, swelling of the opposite end-treated portions 61*c* with the second surface treatment do not generate, and therefore, the boundary step height does not appear. In Comparison Example 2, a cleaning blade subjected to only the second surface treatment without being subjected to the first surface treatment is prepared. In Comparison Example 2, it is understood that the opposite end-treated portions 61*c* are liable to swell correspondingly to low dynamic hardness of the blade surface before being subjected to the second surface treatment and thus a large boundary step height compared with the boundary step height in Comparison Example 1 generates. In Comparison Example 3, a cleaning blade which is not subjected to both the first surface treatment and the second surface treatment. In Comparison Example 3, the boundary step height does not generate, and the dynamic hardness DH1 of the first region A1 and the dynamic hardness DH2 of the second region A2 are the same as those of the molded blade member in the case where the surface treatments are not performed.

In the evaluation test, each of samples of the cleaning blades was mounted in the above-described image forming apparatus and images were printed on 20,000 sheets, and then the surface of the photosensitive drum 1 was cleaned with the cleaning blade. Further, every printing of the images on a certain number of sheets, whether or not curling-up of the blade occurred and whether or not slipping through of the toner occurred were checked. In order to perform evaluation in a severer condition, the evaluation test as to the curling-up of the blade was conducted in a high temperature and high humidity environment (room temperature: 30° C., humidity: 80% RH), and the valuation test as to the slipping-through of the toner was conducted in a low temperature and low humidity environment (room temperature: 15° C., humidity: 10% RH). In Table 1, the number of sheets at which the curling-up of the blade or the slipping-through of the toner occurred is shown, and in the case where these phenomenon did not occur until the printing of the images on 20,000 sheets, the evaluation result is represented by "○".

As shown in Table 1, as regards the cleaning blade of Embodiment 1, the curling-up of the blade did not occur, and the slipping-through of the toner was not observed. On the other hand, in Comparison Example 1 in which the second surface treatment was not performed and the opposite end-treated portions 61*c* were not formed, the curling-up of the blade occurred at the time of printing of the images on about 8,000 sheets. Further, in Comparison Example 2 in which the boundary step height is larger than the boundary step height in Comparison Example 1, the slipping-through of the toner occurred at the time of printing of the images on about 2,000 sheets. In Comparison Example 3 in which the first surface treatment and the second surface treatment were not performed, the curling-up of the blade occurred at the time of printing of the images on about 7,000 sheets. From the above result, it was confirmed that it is possible to not only suppress the curling-up of the free end portion of the blade but also reduce a degree of the slipping-through of the toner by using the cleaning blade according to this embodiment.

TABLE 1

| Item | EMB.1 | COMP.EX.1 | COMP.EX.2 | COMP.EX.3 |
|---|---|---|---|---|
| FCT*1 | YES | YES | NO | NO |
| SCT*2 | YES | NO | YES | NO |
| DH*3 | 0.13 | 0.13 | 0.12 | 0.12 |
| DH*4 | 0.32 | (0.13) | 0.30 | (0.12) |
| BSH*5 | 11 | 0 | 26 | 0 |
| BTU*6 | ○ | 8000 | ○ | 7000 |
| TST*7 | ○ | ○ | 2000 | ○ |

*1: "FCT" is the first curing treatment.
*2: "SCT" is the second curing treatment.
*3: "DH1" is the dynamic hardness DH1 [mN/(μm × μm)] in the first treatment region.
*4: "DH2" is the dynamic hardness DH2 [mN/(μm × μm)] in the second treatment region.
*5: "BSH" is the boundary step height [μm].
*6: "BTU" is the blade curling-up (unit: sheets).
*7: "TST" is the toner slipping-though (unit: sheets).

According to the present invention, it is possible to not only suppress the curling-up of the cleaning blade but also reduce a degree of the slipping-through of the toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-135335 filed on Jul. 18, 2018, which is hereby incorporated by reference herein in its entirety.

What is claimed is:

1. A cleaning blade for cleaning a surface of an image bearing member, said cleaning blade comprising:

an elastic material as a base material;

a first surface;

a second surface opposite from said first surface with respect to a thickness direction of said cleaning blade; and an end surface extending in the thickness direction and connecting said first surface and said second surface, wherein said cleaning blade is contactable to the image bearing member at an edge line portion between said first surface and said end surface, wherein said end surface includes a first region including a central position thereof with respect to a longitudinal direction of the image bearing member and includes a second region provided on each of one side and the other side of said first region with respect to the longitudinal direction, and said elastic material has indentation elastic modulus $E_0$ [MPa] of 3 to 20 at a depth of 1000 μm from said end surface and at an intermediary position between said first surface and said second surface, wherein indentation elastic modulus $E_1$ [MPa] of said end surface in said first region is ($E_0$+1) to 40, dynamic hardness DH1 [mN/μm$^2$] of said first region is 0.10 to 0.20, dynamic hardness DH2 [mN/μm$^2$] of said second region is 0.15 to 0.50, and a difference (DH2−DH1) in dynamic hardness between said first region and said second region is 0.05 [mN/μm$^2$] or more, and wherein a difference in dimension in the thickness direction between said end surface in said first region and said end surface in said second region is 25 μm or less.

2. The cleaning blade according to claim 1, wherein the difference in dimension in the thickness direction between said end surface in said first region and said end surface in said second region is 15 μm or less.

3. The cleaning blade according to claim 1, wherein the indentation elastic modulus $E_0$ [MPa] is 5 or more, the indentation elastic modulus $E_1$ [MPa] is ($E_0$+3) or more, and the dynamic hardness DH2 [mN/μm$^2$] is 0.20 to 0.40.

4. The cleaning blade according to claim 1, wherein in a case that dynamic hardness of a cut surface obtained by cutting said cleaning blade vertically to said end surface is measured, when local maximum depths from said end surface of a portion where a measured value is 70% or more of a reference value which is a measured value at a position 10 μm apart from said end surface are a first depth in the first region and a second depth in the second region, the first depth is 10 μm to 100 μm and the second depth is 100 μm to 500 μm.

5. The cleaning blade according to claim 1, wherein said elastic material is an urethane rubber, and said urethane rubber contains, in said first region and said second region, a composition including a polyol and an isocyanate compound having a plurality of isocyanate groups in a molecule or a composition including a prepolymer having a terminal isocyanate group, and contains, in said second region, an isocyanate compound having at least one isocyanate group in a molecule.

6. A process cartridge comprising:

an image bearing member;

a charging device configured to electrically charge a surface of said image bearing member;

a developing device including a developer carrying member, for carrying a developer containing toner and configured to develop, into a toner image, a latent image formed on said image bearing member by an exposure device; and the cleaning blade according to claim 1 configured to clean the surface of said image bearing member, wherein with respect to a longitudinal direction of said image bearing member, an end portion on an outside of a developer carrying region where the developer carrying member is capable of carrying the developer is positioned outside an image forming region where the exposure device is capable of forming the latent image on said image bearing member, and a boundary position of said cleaning blade between said first region and said second region with respect to the longitudinal direction is outside of the image forming region and inside of the developer carrying region with respect to the longitudinal direction.

7. An image forming apparatus comprising:

an image bearing member;

an exposure device configured to expose said image bearing member to light to write a latent image on a surface of said image bearing member;

a developing device including a developer carrying member, for carrying a developer containing toner and configured to develop, into a toner image, the latent image borne on said image bearing member;

a transfer device configured to transfer the toner image from said image bearing member onto a recording material; and the cleaning blade according to claim 1 configured to clean the surface of said image bearing member, wherein with respect to a longitudinal direction of said image bearing member, an end portion on an outside of a developer carrying region where the developer carrying member is capable of carrying the developer is positioned outside an image forming region where the exposure device is capable of forming the latent image on said image bearing member, and a boundary position of said cleaning blade between said first region and said second region with respect to the longitudinal direction is outside of the image forming region and inside of the developer carrying region with respect to the longitudinal direction.

8. A manufacturing method of a cleaning blade for cleaning a surface of an image bearing member, said manufacturing method comprising:

a molding step of molding an elastic material as a base material into a plate-like molded blade member including a first surface, a second surface opposite from the first surface with respect to a thickness direction of the cleaning blade, and an end surface extending in the thickness direction and connecting the first surface and the second surface, wherein the elastic material has indentation elastic modulus $E_0$ [MPa] of 3 to 20;

a first treatment step of curing a curable material in a first region and a second region of the end surface of the molded blade member so that indentation elastic modulus $E_1$ [MPa] of the end surface is ($E_0$+1) to 40 and so that dynamic hardness DH1 [mN/μm$^2$] of the end surface is 0.10 to 0.20, wherein the first region is a region including a central position of the end surface with respect to a longitudinal direction of the image bearing member, and wherein the second region is a region provided on each of one side and the other side of the first region with respect to the longitudinal direction; and a second treatment step of curing an isocyanate compound in the second region of the molded blade member through impregnation of the isocyanate compound in the molded blade member in the second region so that dynamic hardness DH2 [mN/μm$^2$] of the second region is 0.15 to 0.50 and so that a difference (DH2−DH1) in dynamic hardness between the first region and the second region is 0.05 [mN/μm$^2$] or more.

9. A cleaning blade configured to clean a surface of an image bearing member, said cleaning blade comprising:

an edge portion to contact said image bearing member; and a base portion supporting said edge portion, said base portion being constituted by an elastic material, wherein said edge portion includes:

a first cured portion subjected to a curing treatment with an isocyanate compound so as to be harder than said base portion;

and a second cured portion, provided on an end portion of said edge portion with respect to a longitudinal direction of said cleaning blade, subjected to the curing treatment with the isocyanate compound so as to be harder than first cured portion, and wherein a difference in thickness of said cleaning blade between said first cured portion and said second cured portion is 25 μm or less, and a difference in dynamic hardness between said first cured portion and said second cured portion is 0.05 [mN/μm$^2$] or more.

10. The cleaning blade according to claim 9, wherein the difference in the thickness of said cleaning blade between said first cured portion and said second cured portion is 15 μm or less.

11. The cleaning blade according to claim 9, wherein indentation elastic modulus $E_0$ [MPa] of said base portion is 5 or more, indentation elastic modulus $E_1$ [MPa] of said first cured portion is ($E_0$+3) or more, and dynamic hardness of said second cured portion [mN/μm$^2$] is 0.20 to 0.40.

12. The cleaning blade according to claim 9, wherein in a case that dynamic hardness of a cut surface obtained by cutting said cleaning blade vertically to said edge portion is measured, when local maximum depths from said edge portion of a portion where a measured value is 70% or more of a reference value which is a measured value at a position 10 μm apart from said edge portion are a first depth in the first cured portion and a second depth in the second cured portion, the first depth is 10 μm to 100 μm and the second depth is 100 μm to 500 μm.

13. The cleaning blade according to claim 9, wherein said elastic material is an urethane rubber, and said urethane rubber contains, in said first cured portion and said second cured portion, a composition including a polyol and an isocyanate compound having a plurality of isocyanate groups in a molecule or a composition including a prepolymer having a terminal isocyanate group, and contains, in said second cured portion, an isocyanate compound having at least one isocyanate group in a molecule.

14. The cleaning blade according to claim 9, wherein indentation elastic modulus $E_0$ [MPa] of said base portion is 3 or more, indentation elastic modulus $E_1$ [MPa] of said first cured portion is ($E_0$+1) or more, dynamic hardness of said first cured portion [mN/μm$^2$] is 0.10 to 0.20, and dynamic hardness of said second cured portion [mN/μm$^2$] is 0.15 to 0.50.

15. A process cartridge comprising:

an image bearing member;

a charging device configured to electrically charge a surface of said image bearing member;

a developing device including a developer carrying member, configured to carry a developer containing toner and configured to develop, into a toner image, a latent image formed on said image bearing member by an exposure device; and the cleaning blade according to claim 9 configured to clean the surface of said image bearing member, wherein with respect to a longitudinal direction of said image bearing member, an end portion on an outside of a developer carrying region where the developer carrying member is capable of carrying the developer is positioned outside an image forming region where the exposure device is capable of forming the latent image on said image bearing member, and a boundary position of said cleaning blade between said first cured portion and said second cured portion with respect to the longitudinal direction is outside of the image forming region and inside of the developer carrying region with respect to the longitudinal direction.

16. An image forming apparatus comprising:

an image bearing member;

an exposure device configured to expose said image bearing member to light to write a latent image on a surface of said image bearing member;

a developing device including a developer carrying member, configured to carry a developer containing toner and configured to develop, into a toner image, the latent image borne on said image bearing member;

a transfer device configured to transfer the toner image from said image bearing member onto a recording material; and the cleaning blade according to claim 9 configured to clean the surface of said image bearing member, wherein with respect to a longitudinal direction of said image bearing member, an end portion on an outside of a developer carrying region where the developer carrying member is capable of carrying the developer is positioned outside an image forming region where the exposure device is capable of forming the latent image on said image bearing member, and a boundary position of said cleaning blade between said first cured portion and said second cured portion with respect to the longitudinal direction is outside of the image forming region and inside of the developer carrying region with respect to the longitudinal direction.

* * * * *